US005740736A

United States Patent [19]

Toyoda

[11] Patent Number: 5,740,736

[45] Date of Patent: Apr. 21, 1998

[54] PRINTING PRESS

[75] Inventor: Hideaki Toyoda, Chiba, Japan

[73] Assignee: Komori Corporation, Tokyo, Japan

[21] Appl. No.: 764,259

[22] Filed: Dec. 12, 1996

[30] Foreign Application Priority Data

Jan. 12, 1996 [JP] Japan ..... 8-003644

[51] Int. Cl.[6] ..... B41F 7/02

[52] U.S. Cl. ..... 101/218; 101/247

[58] Field of Search ..... 101/247, 218, 101/143, 144, 145, 177, 182, 184, 185

[56] References Cited

U.S. PATENT DOCUMENTS

| | | | |
|---|---|---|---|
| 2,212,820 | 8/1940 | Barber . | |
| 4,240,346 | 12/1980 | Landis et al. | 101/225 |
| 4,351,237 | 9/1982 | Tappert et al. . | |
| 4,372,204 | 2/1983 | Herzan et al. | 101/145 |
| 4,538,513 | 9/1985 | Sedlak et al. | 101/144 |
| 4,596,183 | 6/1986 | Steiner et al. . | |
| 4,723,488 | 2/1988 | Inouye et al. | 101/218 |
| 4,919,046 | 4/1990 | Kakko-Chiloff | 101/177 |
| 5,142,981 | 9/1992 | Dettinger et al. | 101/218 |
| 5,152,220 | 10/1992 | Lindner et al. . | |
| 5,272,975 | 12/1993 | Dettinger et al. | 101/218 |
| 5,337,664 | 8/1994 | Hannon | 101/218 |
| 5,445,076 | 8/1995 | Sugiyama | 101/218 |
| 5,588,362 | 12/1996 | Sugiyama et al. | 101/218 |

FOREIGN PATENT DOCUMENTS

| | | |
|---|---|---|
| 549085A1 | 6/1993 | European Pat. Off. . |
| 1561071 | 7/1970 | Germany . |
| 3424723C1 | 3/1986 | Germany . |
| 63-151839 | 10/1988 | Japan . |

*Primary Examiner*—Eugene H. Eickholt

*Attorney, Agent, or Firm*—Birch, Stewart, Kolasch & Birch, LLP

[57] ABSTRACT

A printing press comprises an impression cylinder and an intaglio cylinder each having a notched portion and an effective impression area; an eccentric bearing for supporting the impression cylinder; a lever locked on one end side to the bearing; a hydraulic cylinder for acting on the other end side of the lever to turn the bearing; a pressure transducer for detecting pressure which acts on the hydraulic cylinder when the impression cylinder is pressed against the intaglio cylinder; a display device for displaying a printing pressure between the impression cylinder and the intaglio cylinder that has been calculated from a detection signal produced by the pressure transducer when the notched portions of both cylinders face each other, and a detection signal produced by the pressure transducer when the effective impression areas of both cylinders face each other; and adjusting screw and threaded shaft for adjusting the pressure of contact between the impression cylinder and the intaglio cylinder by changing the position of the hydraulic cylinder.

6 Claims, 5 Drawing Sheets

DURING RELEASE OF PRINTING PRESSURE (HEAD PRESSURE $P_1$)

DURING APPLICATION OF PRINTING PRESSURE (HEAD PRESSURE $P_2$)

PRINTING PRESS

BACKGROUND OF THE INVENTION

1. Field of the Invention

This invention relates to a printing press.

2. Description of the Related Art

In a web offset printing press, especially, an intaglio printing press, during printing onto papers passing between a plate cylinder and an impression cylinder, a high printing pressure may act as a printing force depending on a core-to-core distance set between both cylinders. Because of this printing pressure, a packing stuck to the surface of the impression cylinder may become thin, or lose elasticity, causing a printing trouble. As a counterforce against the printing pressure, an excessive bending stress may emerge in the cylinder shaft, causing a breakage accident or damage to the bearing.

The applicant proposed in Japanese Utility Model Publication No. 6-5167 a printing pressure display device of a web offset printing press which has a bearing fitted into a frame so as to journal the end of a shaft of a cylinder subject to a printing pressure; and has a strain gauge attached to a frame surface adjacent to the bearing for detecting compressive strain; wherein the amount of strain is displayed to give knowledge of the magnitude of the printing pressure.

With the above-described conventional printing pressure display device, however, the temperature of the frame rises from room temperature to up to 50° C. because of heat generated during printing. Thus, the frame undergoes strain, posing difficulty in accurately measuring compressive strain due to the printing pressure. Furthermore, the inability to directly display the printing pressure makes the management of the printing pressure difficult. The printing pressure may become too high owing to thermal expansion of the cylinder, causing shaft breakage or bearing damage. Conversely, the printing pressure may become too low because of wear of the cylinder surface, inducing printing malfunctions.

SUMMARY OF THE INVENTION

It is an object of the present invention to provide a printing press in which printing pressure can be displayed correctly and is easy to manage.

A first aspect of the present invention for attaining this object comprises one cylinder having a notched portion and an effective impression area; another cylinder having a notched portion and an effective impression area; an eccentric bearing for supporting the other cylinder; a lever locked on one end side to the eccentric bearing; a fluid pressure cylinder for acting on the other end side of the lever to turn the eccentric bearing; adjusting means for adjusting the pressure of contact between the one cylinder and the other cylinder; fluid pressure detecting means for detecting a fluid pressure which acts on the fluid pressure cylinder when the other cylinder is pressed against the one cylinder; and display means for displaying a printing pressure between the one cylinder and the other cylinder that has been calculated from a detection signal produced by the fluid pressure detecting means when the notched portions of the two cylinders face each other, and a detection signal produced by the fluid pressure detecting means when the effective impression areas of the two cylinders face each other.

According to the foregoing aspect, the printing pressure is calculated from the pressure difference between the head pressure of the fluid pressure cylinder during application of the printing pressure and the head pressure of the fluid pressure cylinder during release of the printing pressure. The calculated printing pressure is displayed, and adjusted to an appropriate value.

As a second aspect of the invention, the above-mentioned printing pressure is preferably obtained from the following equation:

$$F \text{ (printing pressure)} = 2L \cdot A \cdot (P_2 - P_1)/e$$

where

L: length of lever,

A: bore sectional area of fluid pressure cylinder, $P_2$: head pressure of fluid pressure cylinder during application of printing pressure, $P_1$: head pressure of fluid pressure cylinder during release of printing pressure, and e: amount of eccentricity.

According to this aspect, the printing pressure is easily calculated using the pressure difference between the head pressure of the fluid pressure cylinder during application of the printing pressure and the head pressure of the fluid pressure cylinder during release of the printing pressure.

A third aspect of the invention comprises one cylinder having a notched portion and an effective impression area; another cylinder having a notched portion and an effective impression area; an eccentric bearing for supporting the other cylinder; a lever locked on one end side to the eccentric bearing; a drive device for acting on the other end side of the lever to turn the eccentric bearing; adjusting means for adjusting the pressure of contact between the one cylinder and the other cylinder; strain detecting means for detecting the strain of the drive device or the lever; and display means for displaying a printing pressure between the one cylinder and the other cylinder that has been calculated from a detection signal produced by the strain detecting means when the notched portions of the two cylinders face each other, and a detection signal produced by the strain detecting means when the effective impression areas of the two cylinders face each other.

According to the foregoing aspect, the printing pressure is calculated from the difference in the amount of strain between the compressive strain of the drive device or the lever during application of the printing pressure and the compressive strain of the drive device or the lever during release of the printing pressure. The calculated printing pressure is displayed, and adjusted to an appropriate value.

As a fourth aspect of the invention, the above-mentioned printing pressure is preferably obtained from the following equation:

$$F \text{ (printing pressure)} = 2S \cdot L \cdot E \cdot \epsilon/e$$

where

L: length of lever,

S: sectional area of drive device or lever,

E: Young's modulus of material of drive device or lever, $\epsilon$: difference in amount of strain between effective impression areas and notched portions, and e: amount of eccentricity.

According to this aspect, the printing pressure is easily calculated using the difference in the amount of strain between the compressive strain of the drive device or the lever during application of the printing pressure and the compressive strain of the drive device or the lever during release of the printing pressure.

As a fifth or sixth aspect of the invention, a safety valve which, when the fluid pressure exceeds a predetermined value, opens to allow the pressure to escape is provided in a fluid pressure circuit of the fluid pressure cylinder or the drive device.

According to this aspect, overload is avoided.

BRIEF DESCRIPTION OF THE DRAWINGS

The present invention will become more fully understood from the following detailed description in conjunction with the accompanying drawings which are given for the purpose of illustration only, and thus are not limitative, and wherein.

DETAILED DESCRIPTION OF THE PREFERRED EMBODIMENTS

[First embodiment]

Figure 1:
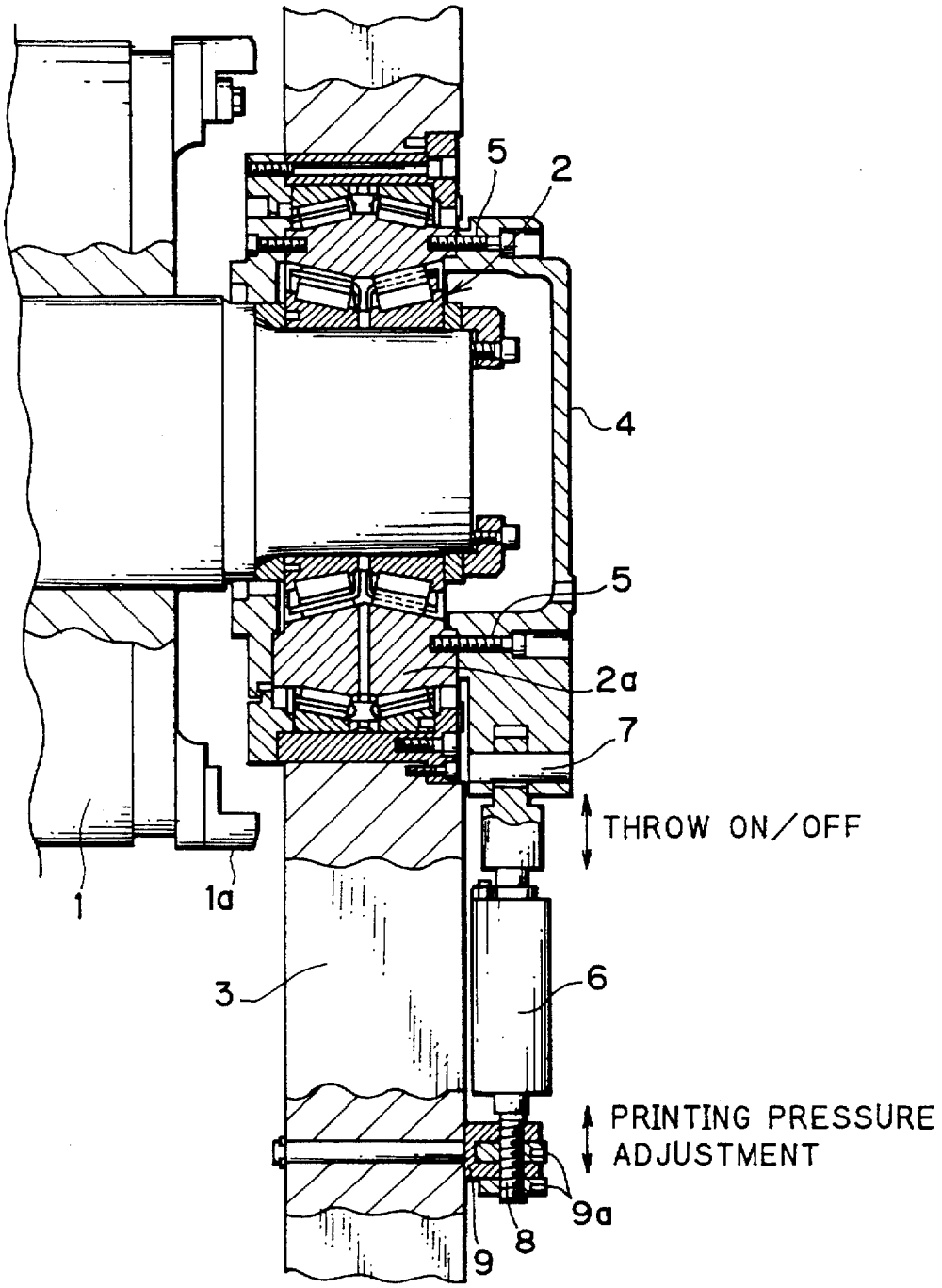
FIG. 1 is a front view of an essential part of a bearing portion of an impression cylinder as a first embodiment of a printing press concerned with the present invention.

As shown in FIG. 1, a shaft end of an impression cylinder 1 of an intaglio printing press is supported by a bearing 2 comprising a triple-race bearing of a double-taper roller so as to be rotatable relative to a frame 3. The numeral 1*a* is a bearer.

A central washer 2*a* of the bearing 2 is formed of an eccentric ring for cylinder throw on/off and printing pressure adjustment. That is, a lever 4 is joined to the central washer 2*a* by bolts 5, and a piston rod tip of a hydraulic cylinder 6 is connected to the lever 4 by a pin 7. A threaded shaft 8 provided at the base end of a cylinder portion of the hydraulic cylinder 6 movably passes through a pin 9 which is rotatable relative to the frame 3. Two nuts 9*a*, upper and lower, are screwed on this passage. The upper nut 9*a* is restrained by the pin 9 from moving in the axial direction of the threaded shaft 8, while the lower nut 9*a* functions as a locking nut.

Thus, the expansion and contraction of the hydraulic cylinder 6 result in marked eccentric rotation of the central washer 2*a* to perform cylinder throw on/off. Furthermore, a screw action by the rotation of the upper nut 9*a* moves the threaded shaft 8 forward or backward to convey a small eccentric rotation to the central washer 2*a*, thereby permitting fine adjustment of the printing pressure.

Figure 3:
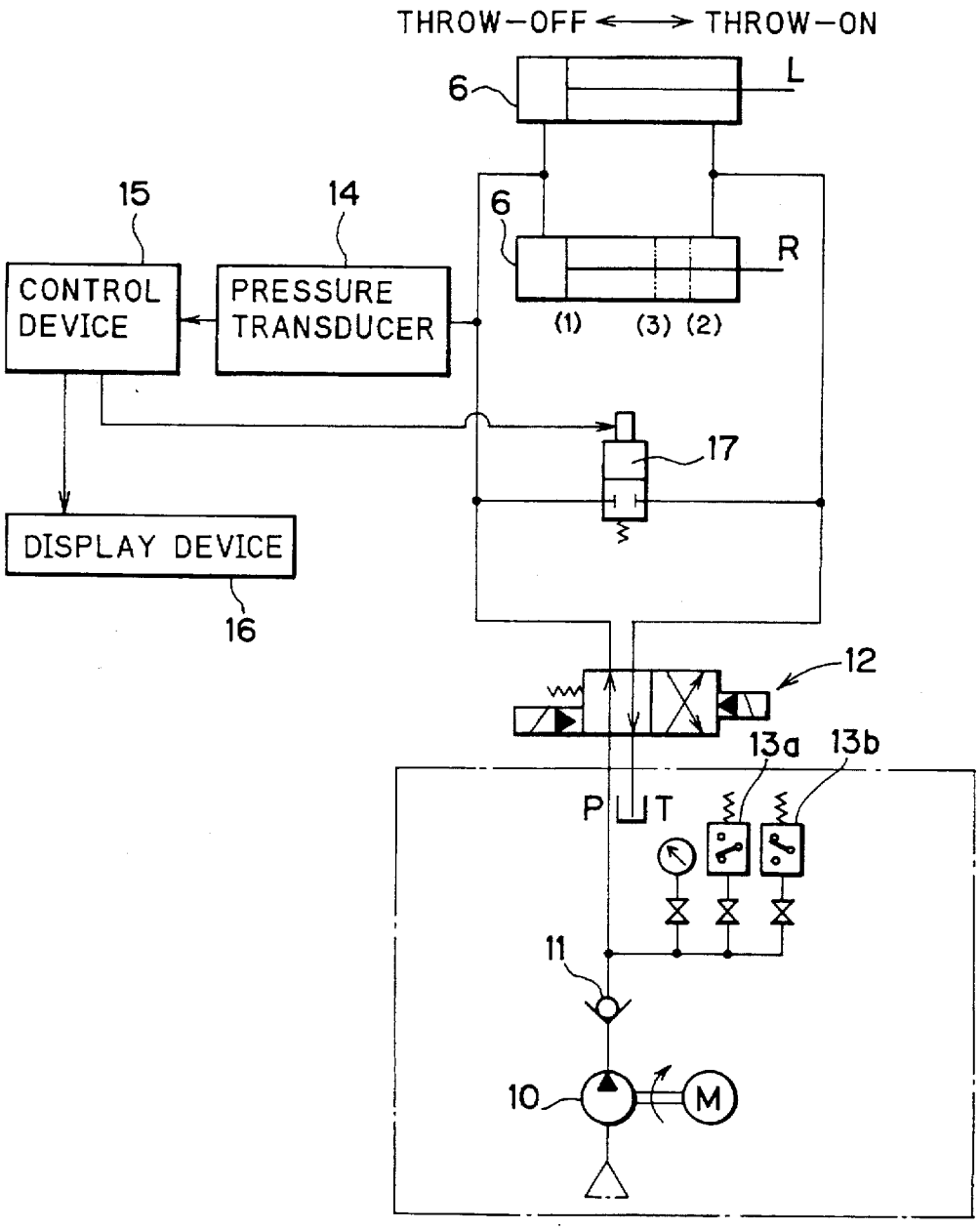
FIG. 3 is a view of a hydraulic circuit of the printing press.

The hydraulic circuit of the hydraulic cylinder 6 is constructed as shown in FIG. 3. That is, pressure oil expelled from a motor-actuated pump 10 is passed through a check valve 11, and fed to the head side of right and left hydraulic cylinders 6 by switching of a solenoid operated selector valve 12, whereupon the piston rod stretches out. At its stroke end, the head-side pressure rises to the set upper limit value of a pressure switch 13*a*. At this time, the pump 10 stops operation, making the pressure oil sealed up in the head side. This brings the impression cylinder 1 into pressed contact with an intaglio cylinder 30 (see FIG. 30). When the pressure oil is fed to the rod side of the right and left hydraulic cylinders 6, on the other hand, the piston rod retracts, throwing the impression cylinder 1 off the intaglio cylinder 30. The numeral 13*b* denotes a pressure switch for regulating the lower limit of the pressure.

In the instant embodiment, a pressure transducer 14 for detecting the head pressure is provided in the head-side circuit, and its detection signals are entered in a control device 15. The control device 15 calculates the printing pressure on the basis of the detection signals, and causes a display device 16 to display this printing pressure digitally. When a predetermined value of the printing pressure is exceeded, the control device 15 opens a safety valve 17 provided in the head-side circuit to lower the head pressure.

Next, the actions of the instant embodiment will be described with reference to FIGS. 3 and 4(*a*), 4(*b*) and 4(*c*).

The state of the hydraulic cylinder 6 in FIG. 3 (the piston position (1)) shows throw-off of the impression cylinder 1 and the intaglio cylinder 30 (the bearer 1*a* is also thrown off). From this state, the pump 10 is operated to feed pressure oil to the head side. At the piston position (2), the impression cylinder 1 and the intaglio cylinder 30 come into a state where only the bearer 1*a* is thrown on and the printing pressure is released [see FIG. 4(*a*) showing the face-to-face relationship of the notched portions of the impression cylinder 1 and the intaglio cylinder 30]. The head pressure $P_1$ in this printing pressure release state is detected by the pressure switch 13*a* to stop the operation of the pump 10.

Figure 4A:
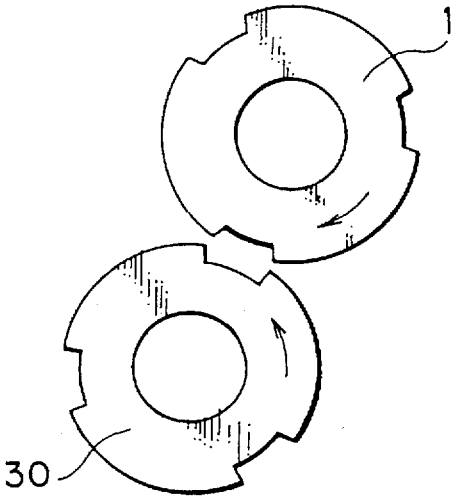
FIGS. 4(*a*), 4(*b*) and 4(*c*) are views illustrating the actions of printing pressure.
Figure 4B:
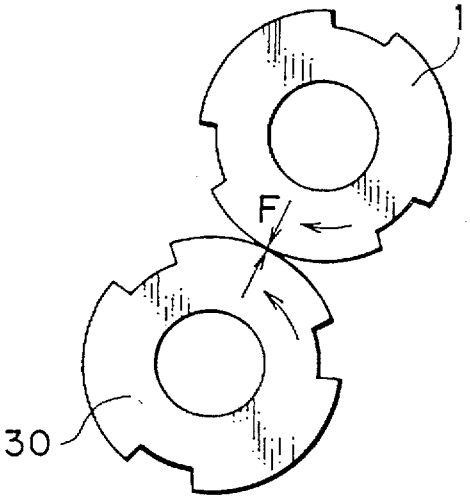
Figure 4C:
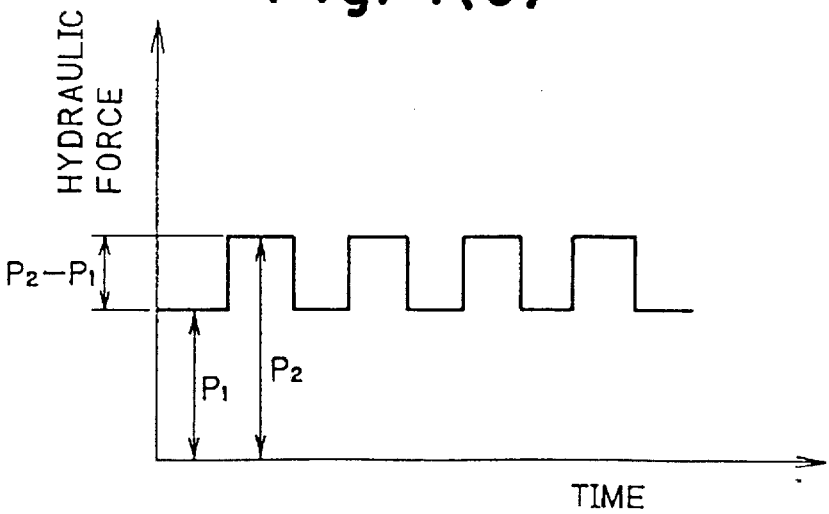

From this state, the machine rotates to bring the impression cylinder 1 and the intaglio cylinder 30 into a throw-on state together with the bearer 1*a*, causing application of the printing pressure [see FIG. 4(*b*) showing the face-to-face relationship of the effective impression areas of the impression cylinder 1 and the intaglio cylinder 30]. In this printing pressure application state, the piston position shifts from (2) to (3), whereupon the head pressure increases from $P_1$ to $P_2$. Subsequently, the printing pressure release state and the printing pressure application state are periodically repeated during printing [see FIG. 4(*c*)].

The head pressures $P_1$ and $P_2$ are detected by the pressure transducer 14. Based on their detected values, the control device 15 calculates the printing pressure using the equation indicated below.

Figure 2:
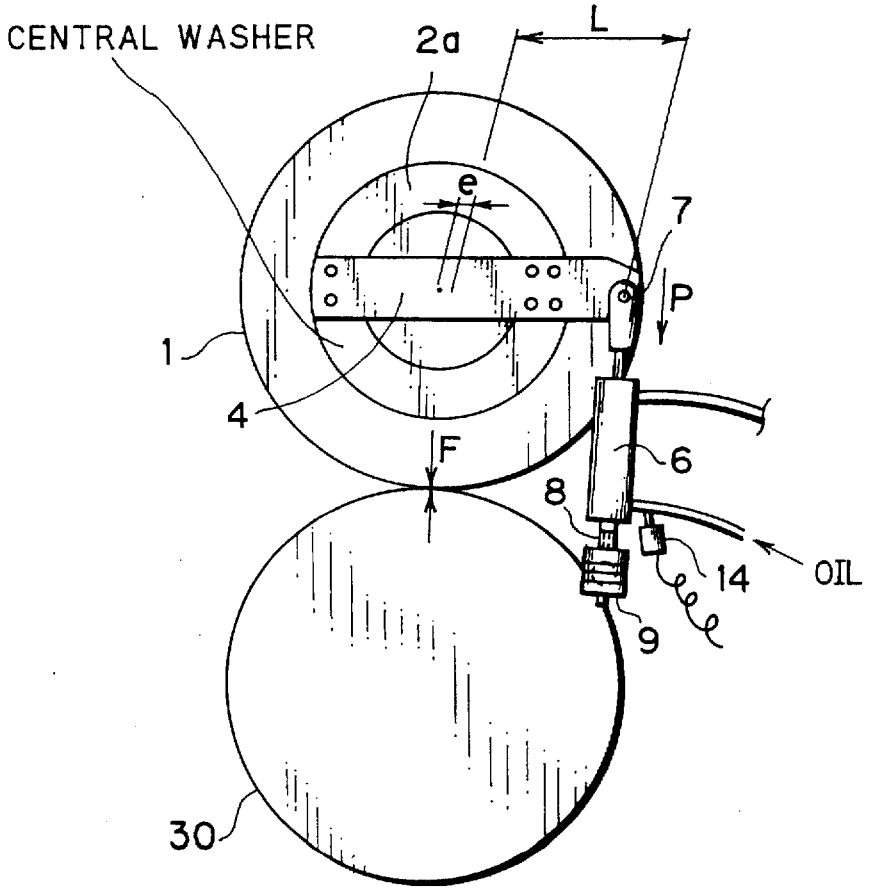
FIG. 2 is a side view of the essential part of the bearing portion of the impression cylinder.

That is, during application of printing pressure, the central washer 2*a* receives a clockwise turning moment (F·e) under the printing pressure F, as shown in FIG. 2. Thus, load P occurs downwardly in the piston rod of the hydraulic cylinder 6, establishing the relationship F×e=P×L×2 (2 is used as a multiplier because of a left-to-right symmetric structure comprising the hydraulic cylinders). The head pressure under this situation is measured as $P_2$, while that during release of printing pressure is measured as $P_1$. Based on the pressure difference ($P_2$–$P_1$), the printing pressure can be calculated.

F (printing pressure)=$2L \cdot A \cdot (P_2 - P_1)/e$ where

L: length of lever (4),

A: bore sectional area of fluid pressure cylinder (6), $P_2$: head pressure of fluid pressure cylinder during application of printing pressure, $P_1$: head pressure of fluid pressure cylinder during release of printing pressure, and e: amount of eccentricity of central washer (2*a*).

Assume here that when A=20 cm$^2$, e=2 cm and L=40 cm, $P_1$ is measured as 50 kgf/cm$^2$, and $P_2$ is measured as 175 kgf/cm$^2$. Then, $$\begin{aligned} F &= 2L \cdot A \cdot (P_2 - P_1)/e \\ &= [2 \times 40 \times 20 \times (175 - 50)]/2 \\ &= 100 \times 10^3\ kgf \\ &= 100 \text{ tons} \end{aligned}$$

The so calculated printing pressure F is digitally displayed by the display device 16. Thus, when the printing pressure F increases owing to thermal expansion of the impression cylinder 1 or the like, the nut 9*a* for printing pressure adjustment is rotated so that the digitally displayed value will become the original value of printing pressure. The original printing pressure F can be restored thereby. If the printing pressure F is to rise excessively, the safety valve 17 opens in response to a signal from the control device 15 to force the head-side pressure oil out, thus causing no damage to the intaglio cylinder 30 or the like.

[Second embodiment]

Figure 5:
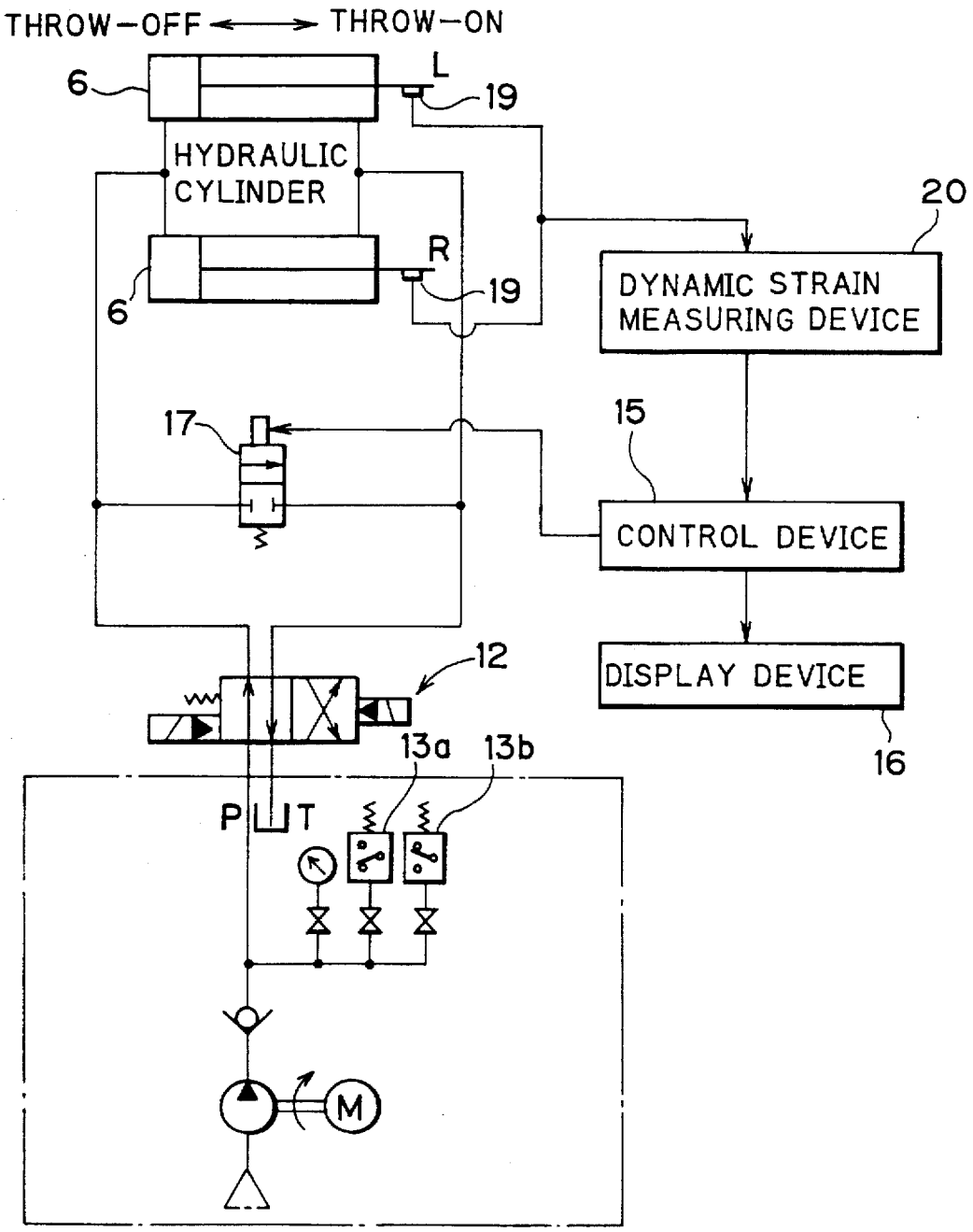
FIG. 5 is a view showing a hydraulic circuit of a second embodiment of the printing press.

FIG. 5 is a view of a hydraulic circuit. As illustrated, this embodiment is designed such that a strain gauge 19 is stuck to a piston rod of a hydraulic cylinder 6 (or a lever 4), which undergoes little adverse influence from heat generated during printing; a dynamic strain measuring device 20 measures, via the strain gauge 19, the compressive strains of the piston rod during application and release of the printing pressure; and a control device 15 calculates printing pressure using the following equation on the basis of these compressive strains. This embodiment obtains the same actions and effects as does the first embodiment.

That is, when the compressive force P of the piston rod is applied to FIG. 2, the relationship $F \times e = P \times L \times 2$ (2 is used as a multiplier because of a left-to-right symmetric structure comprising the hydraulic cylinders) is established. Since the compressive force P of the piston rod is determined by $P = S \times \delta$ (average stress of the cross section)$= S \times E\epsilon$, the printing pressure can be calculated.

F (printing pressure)$= 2S \cdot L \cdot E \cdot \epsilon / e$ where

L: length of lever (4),

S: sectional area of drive device or lever (piston rod of hydraulic cylinder 6), E: Young's modulus of material of drive device or lever (piston rod of hydraulic cylinder 6), $\epsilon$: difference in amount of strain between effective impression areas and notched portions, and e: amount of eccentricity.

Assume here that $E = 2.1 \times 10^4$ kgf/mm$^2$, L=400 mm, e=20 mm, S=900 mm$^2$, and $\epsilon = 1.0 \times 10^4$. Then, $$\begin{aligned} F &= 2S \cdot L \cdot E \cdot \epsilon / e \\ &= (2 \times 900 \times 400 \times 2.1 \times 10^4 \times 1.0 \times 10^{-4})/20 \\ &= 75600\ kgf \\ &= 75.6 \text{ tons} \end{aligned}$$

In the respective embodiments, the nut or the like for printing pressure adjustment is manually operated during printing pressure adjustment, thereby returning the printing pressure to that at the start of printing. However, there may be an embodiment in which the nut or the like is replaced by a gear; the gear is connected to a motor; the printing pressure at the start of printing is entered in the control device to use the entered value as a target value; and if the printing pressure varies during printing, the control device instructs the motor to be driven so that the printing pressure reaches the target value. By so doing, printing pressure adjustment can be automated, and printing can be done according to the data from the equations.

The printing pressure has been digitally displayed, but may be displayed by a pointer type gauge.

The present invention is not restricted to an intaglio printing press, but may be applied to adjustment of printing pressure between a blanket cylinder and a plate cylinder, between a blanket cylinder and an impression cylinder, or between a blanket cylinder and a blanket cylinder.

The first aspect of the invention comprises one cylinder having a notched portion and an effective impression area; another cylinder having a notched portion and an effective impression area; an eccentric bearing for supporting the other cylinder; a lever locked on one end side to the eccentric bearing; a fluid pressure cylinder for acting on the other end side of the lever to turn the eccentric bearing; adjusting means for adjusting the pressure of contact between the one cylinder and the other cylinder; fluid pressure detecting means for detecting a fluid pressure which acts on the fluid pressure cylinder when the other cylinder is pressed against the one cylinder; and display means for displaying a printing pressure between the one cylinder and the other cylinder that has been calculated from a detection signal produced by the fluid pressure detecting means when the notched portions of the two cylinders face each other, and a detection signal produced by the fluid pressure detecting means when the effective impression areas of the two cylinders face each other. Thus, the printing pressure is accurately calculated from the pressure difference between the head pressure of the fluid pressure cylinder during application of the printing pressure and the head pressure of the fluid pressure cylinder during release of the printing pressure. The calculated printing pressure is displayed, and adjusted to an appropriate value. Consequently, management of the printing pressure is facilitated, and printing quality is improved.

According to the second aspect of the invention, the printing pressure is obtained from the following equation, so that the printing pressure is calculated easily and accurately using the pressure difference between the head pressure of the fluid pressure cylinder during application of the printing pressure and the head pressure of the fluid pressure cylinder during release of the printing pressure.

F (printing pressure)$= 2L \cdot A \cdot (P_2 - P_1)/e$ where

L: length of lever,

A: bore sectional area of fluid pressure cylinder, $P_2$: head pressure of fluid pressure cylinder during application of printing pressure, $P_1$: head pressure of fluid pressure cylinder during release of printing pressure, and e: amount of eccentricity.

The third aspect of the invention comprises one cylinder having a notched portion and an effective impression area; another cylinder having a notched portion and an effective impression area; an eccentric bearing for supporting the other cylinder; a lever locked on one end side to the eccentric bearing; a drive device for acting on the other end side of the lever to turn the eccentric bearing; adjusting means for adjusting the pressure of contact between the one cylinder and the other cylinder; strain detecting means for detecting the strain of the drive device or the lever; and display means for displaying a printing pressure between the one cylinder and the other cylinder that has been calculated from a detection signal produced by the strain detecting means when the notched portions of the two cylinders face each other, and a detection signal produced by the strain detecting means when the effective impression areas of the two cylinders face each other. Thus, the printing pressure is accurately calculated from the difference in the amount of strain between the compressive strain of the drive device or the lever during application of the printing pressure and the compressive strain of the drive device or the lever during release of the printing pressure. The calculated printing pressure is displayed, and adjusted to an appropriate value.

According to the fourth aspect of the invention, the printing pressure is obtained from the following equation, so that the printing pressure is calculated easily and accurately using the difference in the amount of strain between the compressive strain of the drive device or the lever during application of the printing pressure and the compressive strain of the drive device or the lever during release of the printing pressure.

F (printing pressure)=$2S \cdot L \cdot E \cdot \epsilon / e$ where

L: length of lever,

S: sectional area of drive device or lever,

E: Young's modulus of material of drive device or lever, $\epsilon$: difference in amount of strain between effective impression areas and notched portions, and e: amount of eccentricity.

According to the fifth and sixth aspects of the invention, a safety valve which, when the fluid pressure exceeds a predetermined value, opens to allow the pressure to escape is provided in a fluid pressure circuit of the fluid pressure cylinder or the drive device. Thus, overload is avoided, and shaft breakage or bearing damage can be prevented.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the following claims.

What is claimed is:

1. A printing press comprising one cylinder having a notched portion and an effective impression area; another cylinder having a notched portion and an effective impression area; an eccentric bearing for supporting said other cylinder; a lever locked on one end side to said eccentric bearing; a fluid pressure cylinder for acting on the other end side of said lever to turn said eccentric bearing; adjusting means for adjusting the pressure of contact between said one cylinder and said other cylinder; fluid pressure detecting means for detecting a fluid pressure which acts on said fluid pressure cylinder when said other cylinder is pressed against said one cylinder; and display means for displaying a printing pressure between said one cylinder and said other cylinder that has been calculated from a detection signal produced by said fluid pressure detecting means when said notched portions of said two cylinders face each other, and a detection signal produced by said fluid pressure detecting means when said effective impression areas of said two cylinders face each other.

2. The printing press of claim 1, wherein said printing pressure is obtained from the following equation:

F (printing pressure)=$2L \cdot A \cdot (P_2 - P_1)/e$ where

L: length of said lever,

A: bore sectional area of said fluid pressure cylinder, $P_2$: head pressure of said fluid pressure cylinder during application of said printing pressure, $P_1$: head pressure of said fluid pressure cylinder during release of said printing pressure, and e: amount of eccentricity.

3. The printing press of claim 1, wherein a safety valve which, when the fluid pressure exceeds a predetermined value, opens to allow the pressure to escape is provided in a fluid pressure circuit of said fluid pressure cylinder.

4. A printing press comprising one cylinder having a notched portion and an effective impression area; another cylinder having a notched portion and an effective impression area; an eccentric bearing for supporting said other cylinder; a lever locked on one end side to said eccentric bearing; a drive device for acting on the other end side of said lever to turn said eccentric bearing; adjusting means for adjusting the pressure of contact between said one cylinder and said other cylinder; strain detecting means for detecting the strain of said drive device or said lever; and display means for displaying a printing pressure between said one cylinder and said other cylinder that has been calculated from a detection signal produced by said strain detecting means when said notched portions of said two cylinders face each other, and a detection signal produced by said strain detecting means when said effective impression areas of said two cylinders face each other.

5. The printing press of claim 4, wherein said printing pressure is obtained from the following equation:

F (printing pressure)=$2S \cdot L \cdot E \cdot \epsilon / e$ where

L: length of said lever,

S: sectional area of said drive device or said lever,

E: Young's modulus of the material of said drive device or said lever, $\epsilon$: difference in the amount of strain between said effective impression areas and said notched portions, and e: amount of eccentricity.

6. The printing press of claim 4, wherein a safety valve which, when the fluid pressure exceeds a predetermined value, opens to allow the pressure to escape is provided in a fluid pressure circuit of said drive device.

* * * * *